United States Patent [19]

Sharp, Jr.

[11] Patent Number: 4,584,897

[45] Date of Patent: Apr. 29, 1986

[54] RELEASE MECHANISM IN KEY ASSEMBLY

[75] Inventor: James M. Sharp, Jr., Corinth, Miss.

[73] Assignee: ITT Corporation, New York, N.Y.

[21] Appl. No.: 684,774

[22] Filed: Dec. 21, 1984

[51] Int. Cl.[4] ..... G05G 1/02; G05G 5/08; H01H 9/20

[52] U.S. Cl. ..... 74/483 PB; 200/50 C; 200/159 R

[58] Field of Search ..... 74/483 PB; 200/5 B, 200/5 E, 5 EA, 50 C, 159 R

[56] References Cited

U.S. PATENT DOCUMENTS

| | | | |
|---|---|---|---|
| 3,164,688 | 1/1965 | Jozefowski | 200/5 EA |
| 3,908,101 | 9/1975 | Kuhfus | 74/483 PB X |
| 3,970,806 | 7/1976 | Distler | 74/483 PB X |

*Primary Examiner*—Allan D. Herrmann

*Attorney, Agent, or Firm*—John T. O'Halloran; Thomas F. Meagher

[57] ABSTRACT

A key assembly having a line button and a hold button includes a release plate which engages pins on the buttons extending transversely of the buttons to a plane of the plate. The plate includes a first tongue having an undercut for receiving the pin of the line button for locking the line button, the first tongue having an inclined edge for urging the plate back from a rest position thereof for insertion of the line button pin in the undercut. The plate includes a second tongue having an inclined edge positioned on a lower portion of said tongue for engagement with the hold button pin on an upstroke of the hold button. A bypass path is provided for the hold button pin, which pin is spring loaded, to enable the pin to travel from the top of the second tongue to the bottom of said second tongue without introducing a translatory motion to the plate. The bypass path includes an inclined plane progressing from an upper edge of the second tongue and facing the hold button pin for urging the pin away from the second tongue so as to travel along the bypass path into engagement with the inclined edge of the second tongue. The configuration of the inclined plane in combination with a rounded end portion of the hold button pin reduces wear in the operation of the key assembly and allows for an integral unitary structure of the plate with the two tongues which facilitates manufacture of the key assembly.

13 Claims, 10 Drawing Figures

RELEASE MECHANISM IN KEY ASSEMBLY

BACKGROUND OF THE INVENTION

This invention relates to a key assembly such as a telephone multiline keyswitch and, more particularly, to the engagement of a line button and a hold button with a release plate by means of pins for locking and releasing the line button.

Key assemblies, such as those used in multiline telephones, employ line buttons connected to separate circuits for making electrical contact with the respective circuits. In addition, the key assemblies include hold buttons which lock and release the line buttons by means of a locking device incorporating a release mechanism. In one common form of locking device, a sliding plate is provided with a tongue and groove configuration for engagement of pins extending transversely from the keys. Movement of the plate provides the lock and release functions. Locking occurs by movement of the plate induced by activation of a line button. Release is accomplished by movement of the plate induced by activation of a hold button. Springs are employed for returning the line button, the hold button, and the plate to their respective rest positions. The plate is frequently referred to as a release plate. The release mechanism concerns the specific configuration of pin and plate whereby the release plate is set into motion by activation of the hold button.

A problem arises in that release mechanisms which have been employed heretofore have required more manual labor and more costly parts in the manufacturing process of keypads than is desirable. This problem may be better understood by consideration of presently available key assemblies.

One form of key assembly employs a torsion spring with a pin attached thereto, the pin sliding in a vertical slot of the release plate. A rib is located on a hold button plunger to operate against the assembly of pin and torsion spring in order to move the release plate. Movement of the release plate releases a depressed line button on the return stroke of the hold button. The hold button is spring loaded, the spring providing for the return stroke upon release of the hold button by a person using the key assembly. The foregoing assembly of the key assembly is labor intensive and subject to adjustment problems during assembly.

As a further example of a presently available key assembly, the key assembly employs a flat cantilever spring having a tab on the end of the spring which serves as a pin integrally formed with the spring. The release plate includes an inclined surface against which is pressed the tab of the spring during operation of the release mechanism. Movement of the release plate releases a depressed line button on the return stroke of the hold button. While the design of this key assembly is simpler than that of the previous example, this key assembly suffers the disadvantage of high cost associated with the fabrication of the flat cantilever spring, which spring has a complex shape. Also, the tab on the end of the spring causes excessive wear on the release plate. As a result, a more expensive plastic material must be used in the manufacture of the release plate than would otherwise be required in order to minimize such wear.

SUMMARY OF THE INVENTION

The foregoing problem is overcome and other advantages are provided by a key assembly having a line button, a hold button, and a locking device for locking the line button, and wherein the key assembly further comprises a release mechanism embodying the invention for unlocking a line button upon activation of the hold button. During a downstroke of the hold button, the release mechanism is readied, and during the return stroke of the hold button, the mechanism operates to release the line button.

A major object of the invention is to construct a locking device of the key assembly and, particularly a release mechanism of the locking device, with a structure that is readily fabricated and resistant to wear. This object is met by the invention by constructing the locking device as a plate having a tongue and cutout configuration with two tongues. One tongue has an inclined edge and an undercut for engagement with a pin of a line button. The second tongue has an inclined edge and an inclined plane for engagement with a spring loaded pin of the hold button. Both pins extend in substantially parallel directions and perpendicularly to a plane of the release plate. Both inclined edges lie within the plane of the plate, and are oriented in approximately perpendicular directions relative to each other so that a downstroke of the line button and an upstroke of the hold button each result in a sliding displacement of the plate against a restraining spring.

In accordance with the invention, the inclined plane faces in a direction transverse to the release plate so as to receive the spring-loaded pin of the hold button during a depression or downstroke of the hold button. Due to the orientation of the inclined plane, no displacement of the release plate takes place in response to the downstroke of the hold button. The effect of the inclined plane is to push the pin against its spring and away from the plate so as to provide a bypass path whereby the pin of the hold button passes alongside the second tongue from the top thereof to come into position at the beginning of the inclined edge at the bottom of the second tongue. Thereby, the release mechanism is set for release of the line button upon the return, or upstroke, of the hold button in a manner which minimizes any wear between the release plate and the pin of the hold button.

BRIEF DESCRIPTION OF THE DRAWING

The foregoing aspects and other features of the invention are explained in the following description taken in connection with the accompanying drawing wherein.

DETAILED DESCRIPTION

Figure 1B:
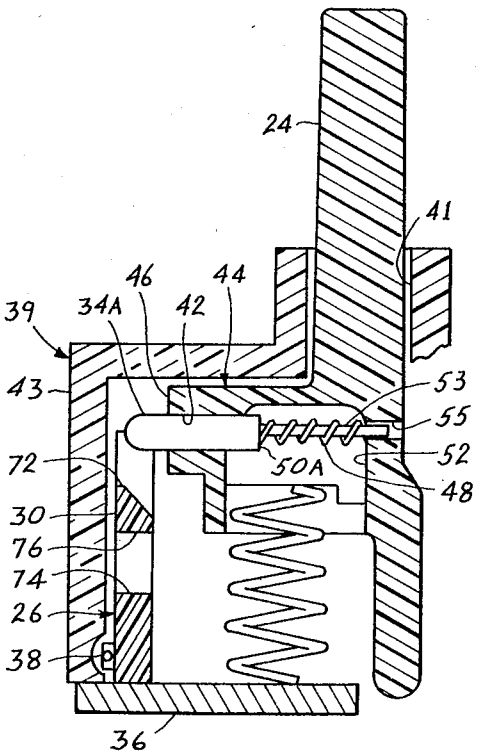
FIG. 1B shows a sectional view of a hold button and release plate taken along the line 1B—1B in FIG. 1A.

The figures show a partial view of a key assembly incorporating the invention, the view of the key assembly showing only those components necessary for an understanding of the construction of the release mechanism of the invention. FIGS. 1A–5A show side elevation views of the same components of the key assembly, the five figures showing successive stages in the operation of the key assembly beginning with the depression of a line button and terminating with the release of the line button. The FIGS. 1B–5B show sectional views of the corresponding stages in the operation, the sectional views further explaining the relationship between a spring-loaded pin of the hold button and movement of the release plate.

With reference to the figures, a key assembly 20 incorporating the invention comprises a line button 22, a hold button 24, a release plate 26 having a first tongue 28 and a second tongue 30, a first pin 32 extending transversely from the line button 22, and a second pin 34 extending transversely from the hold button 24. The plate 26 is slidably mounted on a base 36 and is urged to the left to a reset position by a spring 38. The spring 38 engages the plate 26 at a slot 40 and is secured by conventional means (not shown) at the opposite end of the spring to the base 36.

A housing or case 39 (shown partially cut-away and only in FIGS. 1A–1B) encloses the lower portion of the key assembly 20 and is provided with apertures 41 through which the buttons 22 and 24 protrude to be accessed by the fingers of a person using the key assembly 20. The case 39 includes a sidewall 43 upstanding from the base 36, and disposed alongside of and parallel to the plate 26.

With reference to FIGS. 2A–2B through FIGS. 5A–5B, the second pin 34 is slidably mounted within a bore 42 in a housing 44 of the hold button 24, the bore 42 and housing 44 forming a guide 46 in which the second pin 34 can translate along its axis against the force of a spring 48 which is interposed between a back end 50 of the pin 34 and a wall 52 of the housing 44. The spring 48 urges the second pin 34 forewardly and outwardly from the housing 44 towards the plate 26. The back end 50 of the pin 34 is flared outwardly to serve as a stop to forward motion of the pin 34 by abutment against the back end of the bore 42. A further spring 54 sets within the housing 44 and urges the hold button 24 away from the base 36.

Figure 1A:
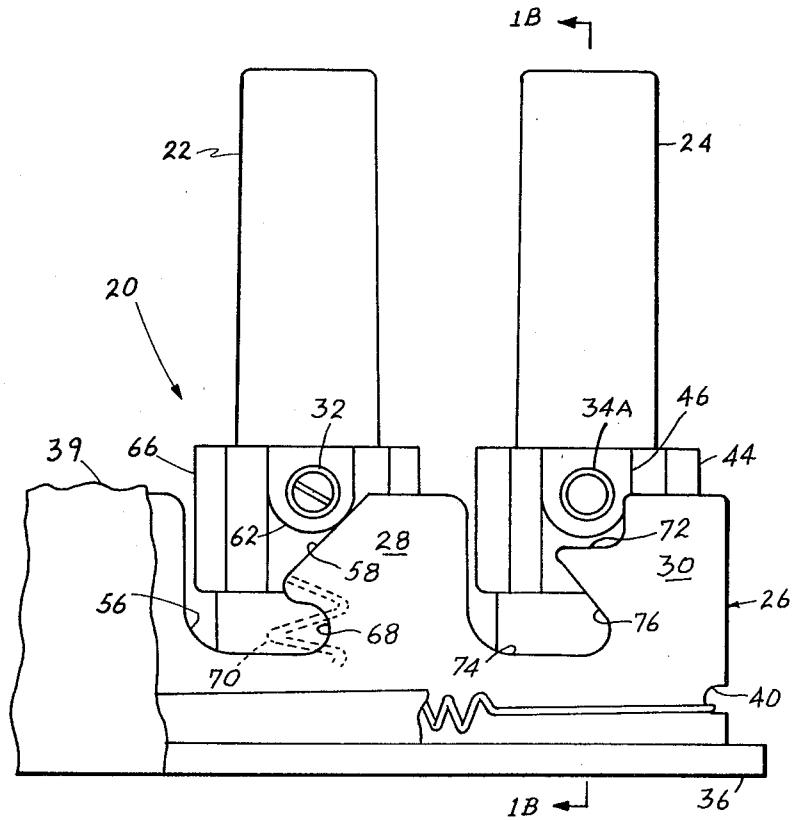
FIG. 1A shows a side elevation view of a portion of a key assembly embodying the invention, the view including a line button, a hold button, and a release plate in their respective positions prior to depresion of the line button.
Figure 2B:
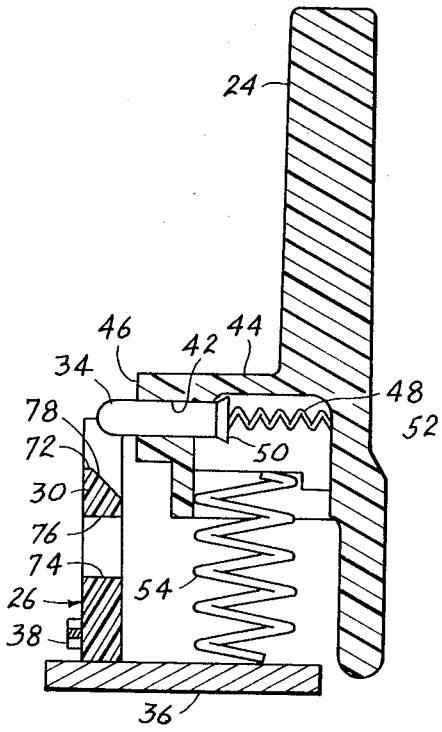
FIGS. 2A–2B show the key assembly components of the corresponding views of FIGS. 1A–1B in their respective positions after depression of the line button.
Figure 2A:
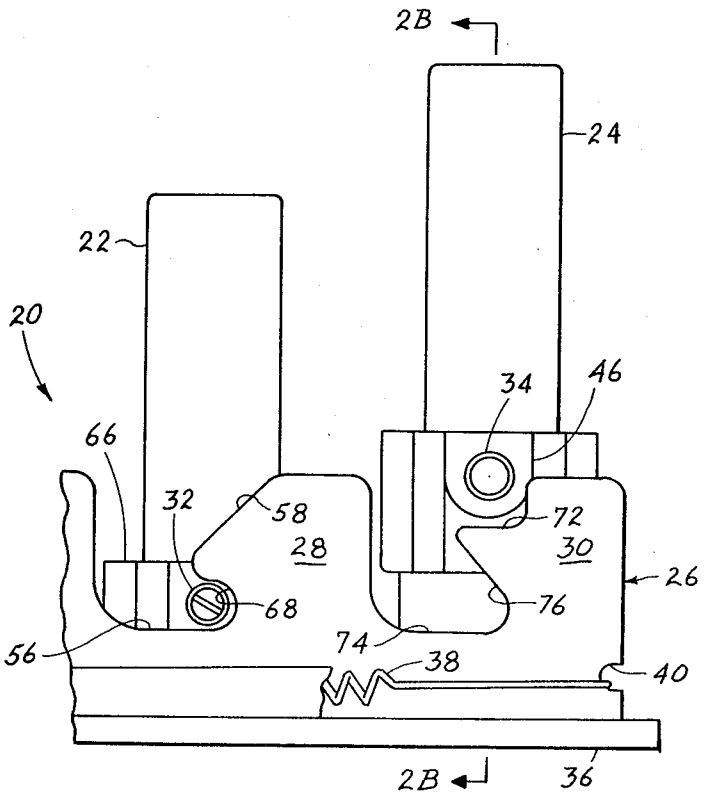

A second pin 34A is shown by way of example in FIGS. 1A–1B as an alternative embodiment of the second pin 34 shown in the other figures. The back end 50A of the second pin 34A is formed with straight sides to permit insertion within the bore 42, while still providing adequate space for receiving an end of the spring 48. As a further feature in this alternative embodiment, the pin 34A is provided with a rod 53 which extends from the back end 50A, through the spring 48, and into a bore 55 located in the wall 52. The rod 53 is slidably mounted within the bore 55, and serves as a guide in retaining the spring 48 in its position during translation of the second pin 34A within the guide 46. Forward movement of the second pin 34A is restrained by abutment of the nose of the pin 34A against the sidewall 43. With the exception of the above-noted differences in the construction and operation of the pins 34 and 34A, the operation of the key assembly 20 is the same for constructions of the key assembly 20 comprising either of the pins 34 or 34A.

The first pin 32 extends into a cutout region 56 in front of the first tongue 28 and rides along an inclined edge 58 during a depression of the line button 22. This riding along the edge 58 by the pin 32 causes the plate 26 to move towards the rear (to the right as depicted in the figures) as the pin 32 moves downward. The first pin 32 is supported by a pedestal 62 which extends from a housing 66 supporting the button 22. The housing 66 can move vertically with the button 22, and constrains the pin 32 to vertical motion during horizontal motion of the plate 26.

The bottom of the cutout region 56 extends beneath the inclined edge 58 to form an undercut 68 which receives the pin 32 after the lower end of the edge 58 clears the pin 32, as the pin 32 advances downward accompanied by the rearward translation of the plate 26. A spring 70 (shown in phantom) is disposed within the housing 66 beneath the line button 22 and urges the line button 22 upwards away from the base 36. The shape of the undercut 68 conforms to the circumference of the pin 32 for trapping and locking the pin 32 in the undercut 68 so as to prevent the spring 70 from returning the line button 22 to its normal, or rest, position. The pin 32 of the line button 22 remains locked within the undercut 68 of the plate 26 until such time as the plate 26 is slid backward (to the right) to free the pin 32 from the undercut 68 and thereby release the button 22 and its pin 32 from the locking engagement with the plate 26.

The second tongue 30 juts out beneath a shelf 72 into a cutout region 74 in the plate 26, and is bounded by an inclined edge 76 which is oriented approximately perpendicularly to the direction of the inclined edge 58 of the first tongue 28. The second pin 34 extends outwardly from the housing 44 of the hold button 24 a sufficient distance for engagement with either edge of the second tongue 30, namely, either the shelf 74 or the inclined edge 76. Because of the reverse inclination of the edge 76, a vertical movement of the second pin 34 can impart a horizontal movement to the plate 26 only during an upstroke of the hold button 24 and its pin 34. The shelf 72 is oriented in a direction normal to the vertical movement of the hold button 24 and its pin 34 so that a contacting of the pin 34 against the shelf 72 produces no horizontal component of force which would urge the plate 26 in a horizontal direction. Accordingly, a downstroke of the hold button 24 imparts no translation to the plate 26.

In accordance with a feature of the invention, the plate 26 is provided with an inclined plane 78 which extends from the shelf 72 in a generally downward direction on the side of the plate 26 facing the hold button 24. Upon a downward displacement of the hold button 24 and its pin 34, the pin 34 is urged into its guide 46 by the inclined plane 78. The end of the second pin 34 is rounded so as to facilitate passage over the inclined plane 78. The inclined plane 78 provides a bypass path of travel for the second pin 34 enabling the pin 34 to travel from the shelf 72 at the top of the second tongue 30 down to the bottom edge, namely, to the beginning of the inclined edge 76 of the second tongue 30. This bypass path is traversed by the second pin 34 during a downstroke of the hold button 24 without imparting any horizontal motion to the plate 26. Upon reaching the end of the downstroke of the hold button 24, the second pin 34 is in position for exerting a force against the inclined edge 76 of the seocn tongue 30, which force exerted normally to the inclined edge 76 has a component in the horizontal direction which urges the plate 26 to move to the right. The movement of the plate 26 in response to the driving force of the second pin 34 occurs during an upstroke of the hold button 24.

Movement of the second pin 34 in the vertical direction, this being perpendicular to the base 36, is attained with the aid of the housing 44 which can move vertically with the buttom 24, and constrains the pin 34 to vertical motion during horizontal motion of the plate 26. The housing 44 and the guide 46, therefore, maintain the vertical motion of the second pin 34 both during a depression of the hold button 24 by a person utilizing the key assembly 20, and during an upstroke of the hold button 24 wherein the hold button 24 is urged upwardly by the spring 54 upon release of the hold button 24 by the person utilizing the key assembly 20.

The operation of the locking and releasing functions of the foregoing key assembly apparatus follows that set forth in FIGS. 1(A and B)–5(A and B). First, the line button 22 is depressed from the position shown in FIG. 1(A and B) to bring the first pin 32 in contact with the inclined edge 58 of the first tongue 28, this resulting in a translation of the release plate 26 to the right. The movement of the plate 26 continues to the right against the force of the spring 38 until the pin 32 clears the bottom of the inclined edge 58 to enter the undercut 68. Thereupon the spring 38 retracts the plate 26 towards the left to lock the pin 32 within the undercut 68. This is shown in FIG. 2(A and B).

Figure 3B:
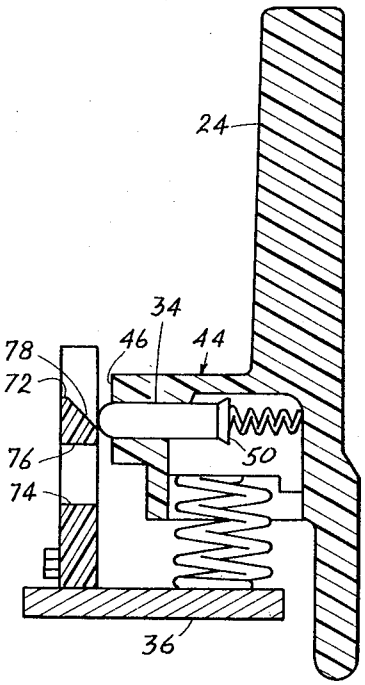
FIGS. 3A–3B show the key assembly components of the corresponding views of FIGS. 1A–1B in their respective positions during a depression of the hold button.
Figure 3A:
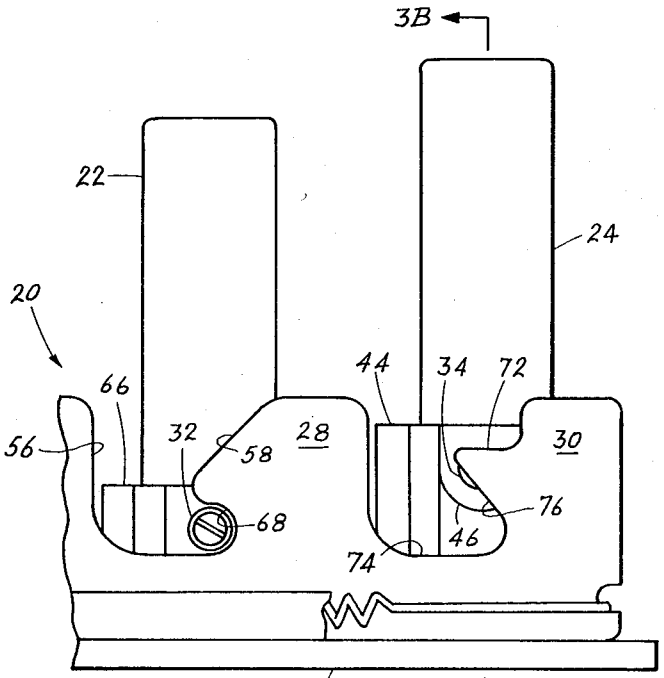

The next stage in the operation begins with the depression of the hold button 24 bringing the second pin 34 through the bypass around the second tongue 30 via the inclined plane 78 as is shown in FIG. 3(A and B). The depression of the hold button 24 is done against the force of the spring 54 which will later expand to drive the hold button 24 in its upstroke. During the bypass of the second tongue 30 by the second pin 34, the plate 26 remains stationary and maintains the line button 22 and its pin 32 in the state of lock.

Figure 4B:
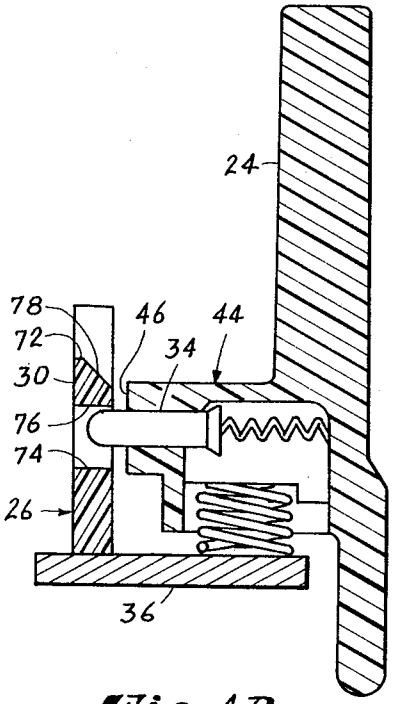
FIGS. 4A–4B show the key assembly components of the corresponding views of FIGS. 1A–1B in their respective positions upon completion of the depression of the hold button.
Figure 4A:
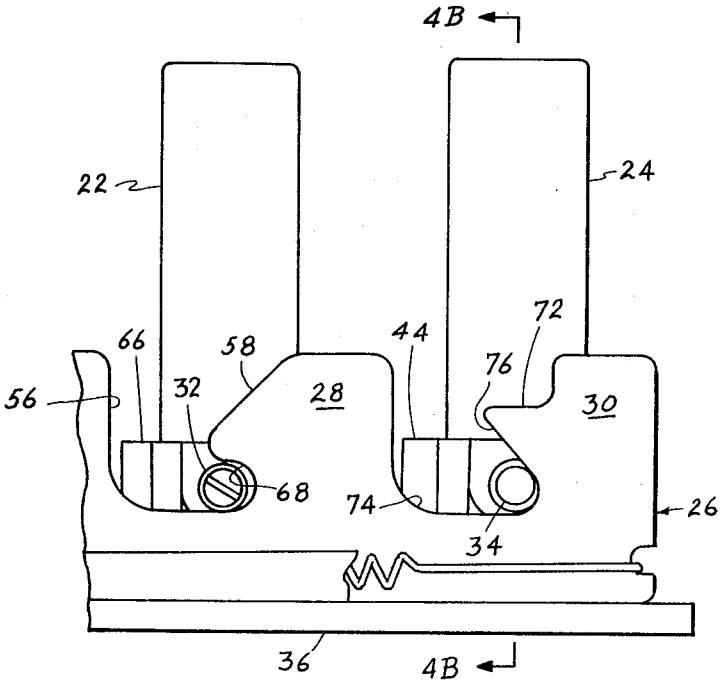
Figure 5B:
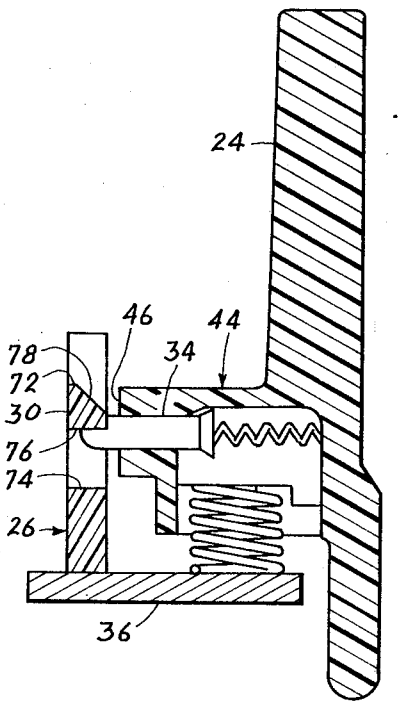
FIGS. 5A–5B show the key assembly components of the corresponding views of FIGS. 1A–1B during an upstroke of the hold button.
Figure 5A:
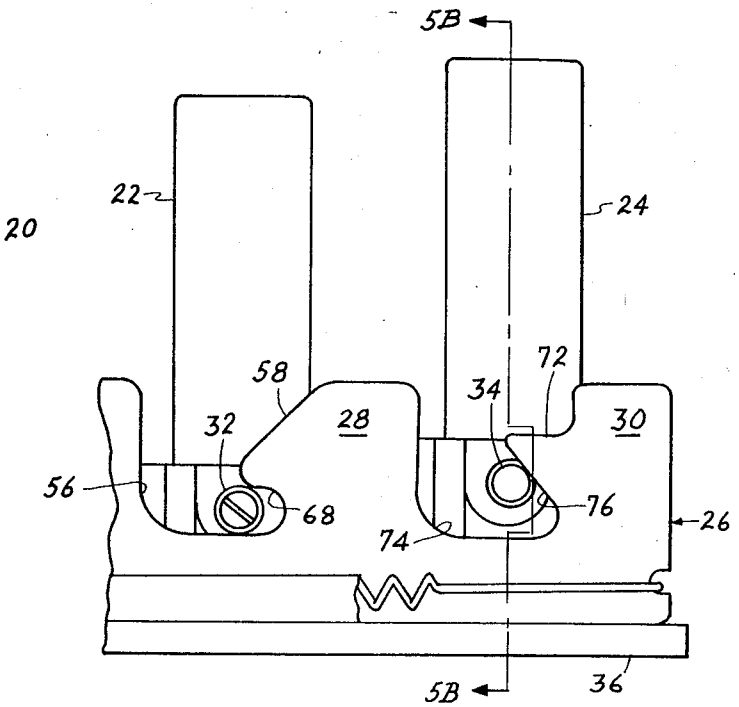

At the completion of the downstroke of the hold button 24, the second pin 34 is in position to contact the inclined edge 76 of the second tongue 30 as is shown in FIG. 4(A and B). Upon release of the hold button 24 by the person utilizing the key assembly 20, the force of the spring 54 urges the pin 34 against the inclined edge 76 to develop a component of force which is parallel to the base 36 and urges the plate 26 to the right, away from its normal or reset position. As the plate 26 moves to the right, driven by the second pin 34, the pin 34 rises under the force of the spring 54, and the first pin 32 begins to exit from the undercut 68 as is shown in FIG. 5(A and B). With still further movement of the plate 26 to the right, the first pin 32 becomes free of the undercut 68, and jumps up with the line button 22 under force of the spring 70 to the rest position. Also, the second pin 34 clears the top of the inclined edge 76 after which the plate 26 is free to move back to the reset position under force of the spring 38. As the plate 26 moves back to the reset position, the second pin 34 assumes its rest position above the shelf 72 as has already been shown in FIG. 1(A and B).

The structure of the plate 26 and the second pin 34 and the guide 46 is relatively simple to manufacture. The buttons 22 and 24 may be fabricated of clear plastic material. The release plate 26 is to be fabricated with the two tongues 28 and 30, and the inclined plane 78 which is readily accomplished by a machining or molding operation. The rounded end of the second pin 34 in combination with the sliding arrangement of the pin 34 within its guide 46 against the force of the spring 48 provides a simple mechanical structure which can be assembled without a step of alignment of parts. The forces exerted by the inclined plane 78 and the spring 48 against the tip of the pin 34 are sufficiently small so as to minimize any tendency to wear. Thereby, the foregoing structure of the invention has enabled the construction of a key assembly with a lock and release feature while maintaining simplicity and economy of the manufacturing process.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A release mechanism suitable for a key assembly having a line button which is manually depressible for altering an electric circuit connection and a hold button which is manually depressible for releasing said line button, said release mechanism comprising:

first spring means for urging said hold button to a rest position upon release from a manual depression thereof;

a first pin extending transversely of said line button and being fixedly secured thereto;

a second pin extending transversely of said hold button and being oriented generally parallel to said first pin, said hold button having a guide, said second pin being slidably secured to said hold button and being mounted within said guide for translatory movement along an axis of said second pin;

second spring means for urging said second pin along its axis to a rest position;

a release plate having a first inclined edge and a second inclined edge, said plate being positioned for engagement with said first pin and said second pin and being slidably mounted for translatory movement transversely of said first pin and said second pin;

third spring means for urging said release plate toward a reset position; and wherein said release plate comprises:

a first tongue bounded by said first inclined edge and an undercut, said first inclined edge being oriented for receiving said first pin during a depression of said line button and introducing a translation of said plate away from said reset position of said plate in response to a force exerted on said first inclined edge by said first pin, said first pin entering said undercut upon completion of a movement of said first pin along said inclined edge of said first tongue; and a second tongue bounded by said second inclined edge and being oriented for receiving said second pin upon release of said hold button, a force exerted on said second inclined edge by said second pin introducing a translation of said release plate away from said reset position to release said first pin from said undercut, thereby releasing said line button; and wherein said second tongue has an inclined plane located on a side of said release plate facing said second pin, said inclined plane displacing said second pin along said guide against a force of said second spring means upon a depression of said hold button so as to enable said second pin to travel in a bypass path around said second tongue to contact said second inclined edge upon completion of a depression stroke of said hold button, and wherein the configuration of said second pin and said second tongue with said bypass path reduces wear in the operation of said key assembly while facilitating manufacture of said key assembly.

2. A release mechanism according to claim 1 wherein said key assembly includes a base, and wherein said first spring means is located betweeen said hold button and said base for urging said hold button away from said base.

3. A release mechanism according to claim 2 wherein said second spring means is a coil spring positioned within a housing of said hold button, said first spring means is a coil spring, and wherein axes of the coil springs of said first and said second spring means are substantially perpendicular to each other for the generation of the respective forces in mutually perpendicular directions.

4. A release mechanism according to claim 3 wherein said third spring means is a coil spring exerting a force between said release plate and said base.

5. A release mechanism according to claim 1 wherein said first tongue and said second tongue with its inclined plane are formed as a unitary structure, and wherein said second pin has a rounded tip for engagement with said inclined plane, the surfaces of said inclined plane and the tip of said second pin being formed for minimizing wear in the operation of said key assembly.

6. A release mechanism according to claim 5 wherein said second tongue is provided with a shelf for receiving said second pin during a rest position of said hold button prior to traveling of said second pin along said bypass path.

7. A release mechanism according to claim 6 wherein said key assembly further comprises a base, motion of said release plate is in a direction parallel to said base, and wherein said key assembly comprises means for constraining movement of said second pin to a linear motion perpendicular to the direction of motion of said release plate.

8. A release mechanism according to claim 6 wherein said bypass path extends from an upper portion of said second tongue to a lower portion of said second tongue, said lower portion being at the beginning of said inclined edge.

9. A release mechanism according to claim 8 wherein said shelf is located in said upper portion of said second tongue.

10. A release mechanism according to claim 5 wherein said guide is formed as a bore within a housing of said hold button, and the tip and a back end of said second pin are sized for fitting within said bore.

11. A release mechanism according to claim 1 wherein said second spring means is a coil spring positioned within a housing of said hold button;

said guide is formed as a bore within a housing of said hold button, and a tip and a back end of said second pin are sized for fitting within said bore; and wherein said said second pin includes a rod extending from said back end through said coil spring for retaining said coil spring in its position within said housing.

12. A release mechanism according to claim 11 wherein said housing includes a wall, an outer end of said rod being slidably secured within a bore of said housing wall.

13. A release mechanism according to claim 1 further comprising a housing enclosing a portion of said key assembly, said housing having a sidewall extending alongside said release plate opposite said second pin for restraining said pin from moving out of said guide.

* * * * *